US005779137A

United States Patent [19]

Coffey

[11] Patent Number: 5,779,137

[45] Date of Patent: Jul. 14, 1998

[54] ROUTING ENVELOPE

[75] Inventor: Carol A. Coffey, Calgary, Canada

[73] Assignee: Calgary Disrict Hospital Group Foundation Ltd., Calgary, Canada

[21] Appl. No.: 761,061

[22] Filed: Dec. 5, 1996

Related U.S. Application Data

[63] Continuation of Ser. No. 457,478, Jun. 1, 1995, abandoned, which is a continuation of Ser. No. 366,030, Dec. 29, 1994, abandoned, which is a continuation of Ser. No. 120,633, Sep. 13, 1993, abandoned, which is a continuation of Ser. No. 927,952, Aug. 11, 1992, abandoned.

[51] Int. Cl.[6] ..... B65D 27/06

[52] U.S. Cl. ..... 229/301; 229/300

[58] Field of Search ..... 229/300, 301, 229/305, 306, 67.1, 67.4, 71.77, 78.22, 92.8; 40/630, 638, 359; 283/81, 116, 117

[56] References Cited

U.S. PATENT DOCUMENTS

| | | | |
|---|---|---|---|
| 661,690 | 11/1900 | Forney | 229/301 X |
| 759,382 | 5/1904 | Klugh | 229/305 |
| 827,208 | 7/1906 | Boston | 229/305 |
| 1,354,092 | 9/1920 | Crate . | |
| 1,378,903 | 5/1921 | Schoreck | 229/306 X |
| 1,412,335 | 4/1922 | Branstead | 229/77 |
| 1,470,051 | 10/1923 | Ashby | 229/305 |
| 1,944,980 | 1/1934 | Hayes | 229/301 X |
| 2,045,944 | 6/1936 | Domke | 229/92.8 |
| 2,374,026 | 4/1945 | McKeen | 229/71 X |
| 2,586,017 | 2/1952 | Freedman | 229/71 X |
| 2,980,315 | 4/1961 | Miner . | |
| 3,126,211 | 3/1964 | Hieken et al. | 383/211 X |
| 3,151,803 | 10/1964 | Kaminski | 229/80 |
| 3,189,254 | 6/1965 | Pattishall | 229/92.8 |
| 3,329,333 | 7/1967 | Ormond | 229/92.8 |
| 3,856,198 | 12/1974 | Daley . | |
| 4,308,988 | 1/1982 | Jiveman et al. | 229/71 X |
| 4,500,021 | 2/1985 | Bildusas | 383/95 X |
| 4,589,590 | 5/1986 | McGuire et al. | 229/92.8 |
| 4,778,100 | 10/1988 | McGuire et al. | 229/303 |
| 4,850,525 | 7/1989 | Haag et al. | 229/314 |
| 4,887,373 | 12/1989 | Macaulay . | |
| 4,932,684 | 6/1990 | Vermeulen . | |
| 5,071,061 | 12/1991 | Willis . | |
| 5,213,258 | 5/1993 | Kim | 229/305 |

FOREIGN PATENT DOCUMENTS

| | | | |
|---|---|---|---|
| 73663 | 11/1921 | Canada . | |
| 1259486 | 9/1989 | Canada . | |
| 19302 | 8/1895 | United Kingdom | 229/305 |
| 547395 | 8/1942 | United Kingdom | 229/306 |

*Primary Examiner*—Jes F. Pascua
*Attorney, Agent, or Firm*—John Russell Uren

[57] ABSTRACT

An inter-office routing envelope where the envelope is a tough man made material completely recyclable and having a multi block addressee label removably adhesively applied to a face thereof. The material of the label and printing ink thereon are readily recyclable. A completely used label is replaced by a new label providing continuing use of the "Tyvek" material envelope.

6 Claims, 1 Drawing Sheet

ROUTING ENVELOPE

This application is a continuation of U.S. patent application Ser. No. 08/457,478 filed Jun. 1, 1995, now abandoned, which in turn, is a continuation of U.S. patent application Ser. No. 08/366,030 filed Dec. 29, 1993, now abandoned, which in turn is a continuation of application Ser. No. 08/120,633, filed Sep. 13, 1993, now abandoned, which in turn is a continuation of U.S. patent application Ser. No. 07/927,952, filed Aug. 11, 1992, now abandoned, the contents of each of the aforementioned applications being incorporated herein by reference.

FIELD OF INVENTION

This invention relates generally to inter-office routing envelopes and more particularly to a recyclable, reusable envelope with a label containing multiple blank spaces for entering addressee routings and which is replacably mountable on the face of the envelope. The routing envelope components are all readily recyclable making it environmentally friendly.

BACKGROUND OF INVENTION

An early form of envelope for repeated use is disclosed in Canadian Patent 73 1663 which issued to H. W. Gays Nov. 5, 1901. The envelope was intended for repeated use and made of a strong material with an opening not to be sealed and a multiple addressee sheet pasted to a face of the envelope.

Following this and more commonly used is a routing envelope made of a Kraft* paper-like material which is printed directly on one face for multiple use addressee information in routing and re-routing the envelope. This typical form of envelope is illustrated in FIG. 1 of U.S. Pat. No. 5,071,061 issued Dec. 10, 1991 to Dale R. Willis. As disclosed therein there are multiple address blocks for writing in successive designation identifiers or addresses and the envelope has a reclosable flap utilizing a string and buttons to hold the flap closed. It is also mentioned that long lasting tack adhesives are also used in some of the newer pouches. The patentee discloses a single address block that is erasable and therefore reusable without the necessity of having a series of blocks printed over the entire envelope.

*Trade-Mark

Another approach in attempting to add longevity to an interoffice envelope is disclosed in U.S. Pat. No. 3,856,198 issued Dec. 24, 1974 to Robert S. Daley. The patentee discloses a two compartment envelope, one of which is intended for the content to be forwarded to the addressee and the other for receiving and exposing the face of a multiple block addressee pad and this permits reusing the envelope and discarding the addressee tab when all areas have been filled and replacing it with another of the same that has blank spaces.

Reusable paper type envelopes have a short life span and have a torn and worn look after relatively short usage. This is a detraction to offices using them as well as being uneconomic and little or no regard given to recycling. The paper type envelopes if used with a self-stick reusable label have to have a release coating applied to the paper so as to render the label strippable without tearing the paper. This makes the envelope more costly and adds to the difficulty if not making recycling impossible.

In order to give more longevity to interoffice routing envelopes plastic film material has been introduced but these envelopes are flimsy having no body to them and rely upon the contents inserted to give them body. By body herein is meant an envelope which is mainly self sustaining. For example when stood on its edge it doesn't collapse as do film plastics envelopes. Frequently interoffice mailings are stood edgewise in a cart when being transported from one location to another and one having body is easier to handle. Flimsy envelopes are not self-supporting and are rendered so only by the content.

SUMMARY OF INVENTION

An object of the present invention is to provide an interoffice routing envelope that is durable, can be recycled and has releasably mounted thereon a routing label without the necessity of a release agent being applied to the envelope and wherein all of the components of the office routing envelope can be recycled.

In accordance with the present invention there is particularly provided a recyclable routing envelope comprising an envelope, with a closable flap, made from recyclable material which is tough, has body so as to be inherently self-supporting and inherently provides a surface from which a label attached thereto by a pressure sensitive adhesive can be peeled without damaging the envelope eliminating the need for a release coating normally and necessarily applied to paper envelopes and a label having a front face and a rear face with an adhesive on at least part of the rear face peelably attaching the label to a face of the envelope, said label having a pre-printed front face providing multi-designated areas for receiving routing instructions. The label and adhesive are recyclable as well as the ink which is preferably vegetable oil based.

LIST OF THE DRAWINGS

The invention is illustrated by way of example in the accompanying drawing wherein:

FIG. 1 is a front elevational view of an interoffice reusable routing envelope provided in accordance with the present invention with one corner of the label thereon lifted for illustrative purposes; and FIG. 2 is an elevational view of the opposite face of the routing envelope.

DESCRIPTION OF THE PREFERRED EMBODIMENT

Figure 1:
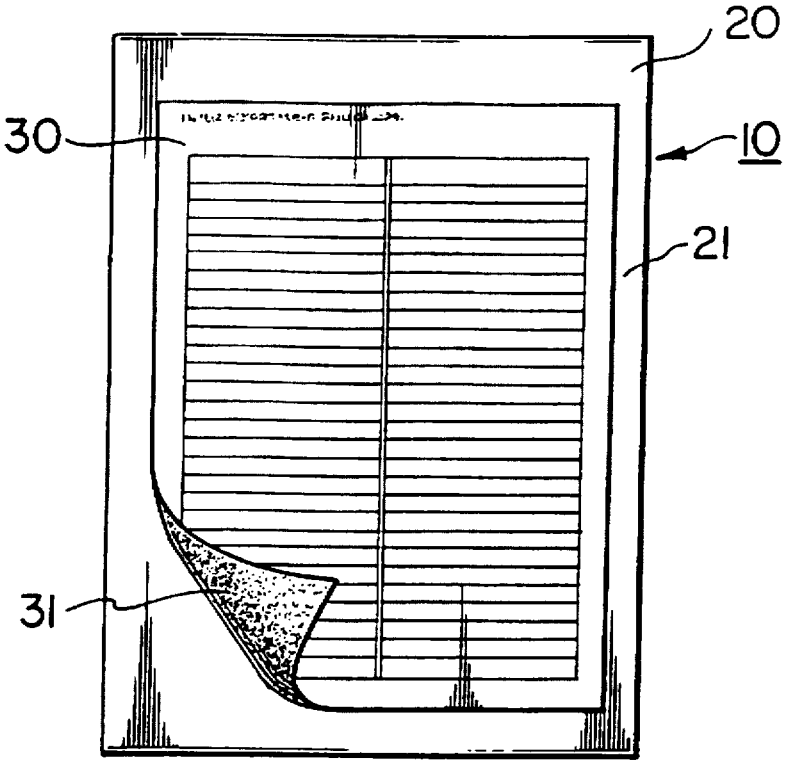
Figure 2:
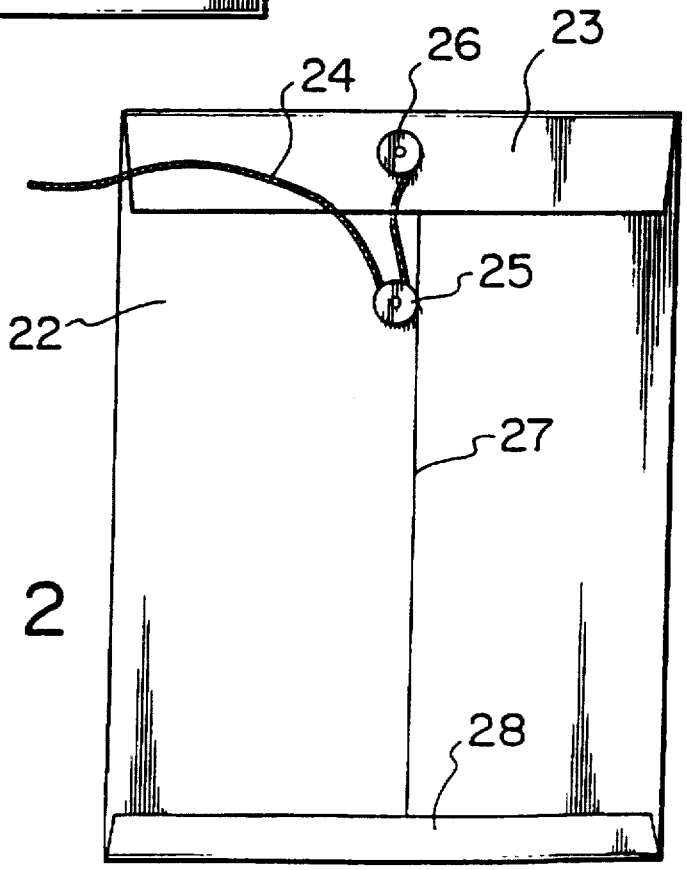

Illustrated in FIG. 1 is a reusable routing envelope 10 consisting of an envelope 20 and a routing label 30 peelably secured to one face of the envelope.

The envelope 20 has a front face 21, a rear face 22 and a hingedly attached flap 23 that covers an open end of the envelope. The openable flap 23 is closed by a string 24 windable around a button 25 fastened to the envelope wall 22 and attached to a button 26 that is fastened to the flap 23. The envelope is a single piece of material folded conventionally and closed by an overlapping glued seam 27 and a bottom glued flap 28.

The envelope of the present invention is made of a recyclable material such as that identified by Dupont's trade-mark Tyvek. The material is a high density polyethylene that is completely recyclable. The envelope may be made of virgin material or a combination of virgin material and recycled material. The material being recyclable is environmentally friendly and has body so as to be self sustaining in the envelope form. In addition to having body and being 100% recyclable it is durable, long lasting, waterproof and may be fairly described as virtually indestructible compared with the conventionally used brown paper inter-office routing envelope. The material for the purpose of the present invention may be considered as having inherently the comparable of a release coating making it possible to readily peel the label 30 from the surface of the envelope without damage to the envelope. The enveloped glued seams utilize a readily recyclable glue.

The label 30 is pre-printed on one face to contain a number of blank spaces and on the opposite face has a pressure sensitive adhesive 31 for adhesively attaching the label to the front face of the envelope. The printing is done using a soluble ink and one which is recyclable, for example, a vegetable oil based ink. These are completely recyclable inks, i.e., environmentally friendly and by way of example are available from Lester Inks of Toronto, Canada.

The label 30 is preferably a recyclable paper product easily marked with a conventional writing instrument, i.e., a pen or pencil. It may however be a plastics material appropriately treated for marking with a writing instrument. Whether the label be a paper product or a plastics product it is intended to be completely recyclable.

The pressure sensitive adhesive 31 may be applied to the entire rear face of the label 30 or alternatively selected portions thereof to attach the label to the face of the envelope. The adhesive chosen is such as to rupture before either that of the label 30 or envelope 20. Pressure sensitive adhesives are well known and the one used herein is a water based resinous adhesive which is readily recyclable. The preferred adhesive has a formulation that is a trade secret of Moore Business Forms Inc. and is known under their trade-mark "Stix".

The interoffice envelope is used with the label 30 attached until all of the routing blocks are filled which, in the embodiment illustrated in FIG. 1, is 52 addressees. The label 30 is then peeled from the face of the envelope and another label 30 applied which has blank spaces for continued reuse of the envelope. The removed label is recycled. The ink being recyclable is environmentally friendly and as previously mentioned may be a vegetable oil based ink such as linseed, soybean or canola based. These inks are free of VOC's and heavy metals.

I claim:

1. An environmentally friendly reusable routing envelope for interoffice use, said envelope being made from non-metallic recyclable material and intended to be transmitted to a plurality of recipients greater than two, said envelope comprising an access opening to allow an item to be inserted into and removed from said envelope, a closure member movable between a first position wherein said access opening is open and a second position wherein said access opening is closed, said envelope having a backside surface and a front outside surface, reusable securing means to maintain said closure member in said closed position on said backside surface, a routing label removably attached to said front outside surface by a pressure sensitive adhesive, said routing label being mounted remotely from said access opening to allow said closure member to be opened or closed without removal of said routing label, said routing label being made of a recyclable material, said pressure sensitive adhesive being applied along the periphery of said routing label for adhering said label to said front outside surface of said envelope, said label having an exposed outer surface preprinted with ink and including multi-designated areas, said multi-designated areas being greater than two, for receiving written routing instructions for said plurality of recipients greater than two for said envelope.

2. The routing envelope as in claim 1 made from a high density polyethylene material.

3. The routing envelope as in claim 1 wherein said adhesive has a bonding strength less than the tear strength of said envelope and label such that said label will release from said envelope before said label or envelope will tear.

4. The routing envelope as in claim 1 wherein said ink is a vegetable oil based ink.

5. The envelope of claim 1 wherein all of the components of said envelope are substantially free of heavy metals.

6. The envelope of claim 5 wherein said pressure sensitive adhesive is water based.

* * * * *